US008636679B2

(12) United States Patent
Linnane et al.

(10) Patent No.: US 8,636,679 B2
(45) Date of Patent: Jan. 28, 2014

(54) COMPRESSION DEVICE FOR THE LIMB

(75) Inventors: Patrick G. Linnane, Ellesmere Port (GB); Ian S. Tabron, Cheshire (GB); Arsenio Fernadez, Bridgend (GB); Anders L. Boström, Ekerö (SE); Peter L. Hansen, Herts (GB); Muhammed Sailm Mirza, Herts (GB)

(73) Assignee: Swelling Solutions, Inc., Minneapolis, MN (US)

( * ) Notice: Subject to any disclaimer, the term of this patent is extended or adjusted under 35 U.S.C. 154(b) by 1384 days.

(21) Appl. No.: 11/255,051

(22) Filed: Oct. 20, 2005

(65) Prior Publication Data

US 2006/0135894 A1 Jun. 22, 2006

(30) Foreign Application Priority Data

Oct. 21, 2004 (GB) ..... 0423410.0

(51) Int. Cl.
*A61H 7/00* (2006.01)
*A61H 19/00* (2006.01)

(52) U.S. Cl.
USPC ..... 601/152

(58) Field of Classification Search
USPC ..... 601/148–152; 602/13; 606/202
See application file for complete search history.

(56) References Cited

U.S. PATENT DOCUMENTS 2,531,074 A * 11/1950 Miller ..... 601/152
4,054,129 A 10/1977 Byars et al.
4,153,050 A 5/1979 Bishop et al.
4,206,751 A * 6/1980 Schneider ..... 601/152
4,320,746 A * 3/1982 Arkans et al. ..... 601/152
4,573,453 A 3/1986 Tissot
4,624,244 A 11/1986 Taheri
4,702,232 A 10/1987 Fox et al.
5,022,387 A 6/1991 Hasty
5,117,812 A 6/1992 McWhorter
5,217,431 A 6/1993 Toronto et al.
5,263,473 A * 11/1993 McWhorter ..... 601/152
5,383,894 A 1/1995 Dye
5,437,610 A 8/1995 Cariapa et al.
5,575,762 A 11/1996 Peeler et al.

(Continued)

FOREIGN PATENT DOCUMENTS

EP 0552515 A1 7/1993
EP 1018329 B1 7/2000

(Continued)

OTHER PUBLICATIONS

International Search Report mailed Dec. 12, 2005 for International Patent Application No. PCT/GB2005/004070, filed Oct. 21, 2005.

(Continued)

*Primary Examiner* — Kristen Matter
(74) *Attorney, Agent, or Firm* — Mueting, Raasch & Gebhardt, P.A.

(57) ABSTRACT

A compression device for a limb has a sleeve adapted to surround the limb. The sleeve has an inelastic layer and a cell constructed from an inner part joined to an outer part by one or more side walls. This construction provides a cell with a box-like configuration so that the inner part conforms to the shape of the limb, providing an even pressure to the limb, when the cell is inflated.

7 Claims, 5 Drawing Sheets

(56) References Cited

U.S. PATENT DOCUMENTS

| | | | | |
|---|---|---|---|---|
| 5,626,556 | A | 5/1997 | Tobler et al. | |
| 5,843,007 | A | 12/1998 | McEwen et al. | |
| 5,876,359 | A | 3/1999 | Bock et al. | |
| 5,891,065 | A | 4/1999 | Cariapa | |
| 5,951,502 | A | 9/1999 | Peeler et al. | |
| 6,007,559 | A | 12/1999 | Arkans | |
| 6,062,244 | A | 5/2000 | Arkans | |
| 6,080,120 | A * | 6/2000 | Sandman et al. | 601/152 |
| 6,131,219 | A * | 10/2000 | Roberts | 5/644 |
| 6,231,532 | B1 | 5/2001 | Watson et al. | |
| 6,290,662 | B1 | 9/2001 | Morris et al. | |
| 6,296,617 | B1 | 10/2001 | Peeler et al. | |
| 6,319,215 | B1 * | 11/2001 | Manor et al. | 601/152 |
| 6,355,008 | B1 | 3/2002 | Nakao | |
| 6,440,093 | B1 | 8/2002 | McEwen et al. | |
| 6,463,934 | B1 | 10/2002 | Johnson, Jr. et al. | |
| 6,494,852 | B1 | 12/2002 | Barak et al. | |
| 6,544,202 | B2 | 4/2003 | McEwen et al. | |
| 6,558,338 | B1 | 5/2003 | Wasserman | |
| 6,592,534 | B1 * | 7/2003 | Rutt et al. | 601/151 |
| 6,846,295 | B1 | 1/2005 | Ben-Nun | |
| 6,988,423 | B2 | 1/2006 | Bolam et al. | |
| 7,001,384 | B2 | 2/2006 | Berish et al. | |
| 7,354,410 | B2 | 4/2008 | Perry et al. | |
| 7,442,175 | B2 | 10/2008 | Meyer et al. | |
| 7,637,922 | B2 | 12/2009 | Johnson et al. | |
| 8,029,451 | B2 | 10/2011 | Meyer et al. | |
| 8,079,970 | B2 | 12/2011 | Meyer et al. | |
| 2002/0007132 | A1 * | 1/2002 | Rothman et al. | 601/148 |
| 2004/0111048 | A1 | 6/2004 | Jensen et al. | |
| 2005/0107725 | A1 * | 5/2005 | Wild et al. | 601/152 |
| 2006/0287672 | A1 | 12/2006 | McEwen et al. | |
| 2009/0018474 | A1 | 1/2009 | Nakao | |
| 2010/0036299 | A1 | 2/2010 | Gough | |
| 2011/0082401 | A1 | 4/2011 | Iker et al. | |
| 2011/0131839 | A1 | 6/2011 | Ballin et al. | |
| 2011/0196269 | A1 | 8/2011 | Arkans | |
| 2011/0245743 | A1 | 10/2011 | Eddy | |

FOREIGN PATENT DOCUMENTS

| | | | |
|---|---|---|---|
| EP | 1226804 | A2 | 7/2002 |
| WO | 93/16665 | | 9/1993 |
| WO | WO 98/56331 | | 12/1998 |
| WO | WO 03/007855 | A1 | 1/2003 |
| WO | WO2004084790 | A | 10/2004 |

OTHER PUBLICATIONS

Written Opinion mailed Dec. 12, 2005 for International Patent Application No. PCT/GB2005/004070, filed Oct. 21, 2005.

International Preliminary Report on Patentability issued Apr. 24, 2007 for International Patent Application No. PCT/GB2005/004070, filed Oct. 21, 2005.

* cited by examiner

COMPRESSION DEVICE FOR THE LIMB

This invention relates to a compression device for the limb and particularly to a device for use on the leg. The device is particularly suited for use in the type of compression therapy used in the treatment of venous leg ulcers.

BACKGROUND OF THE INVENTION

Various compression devices are known for applying compressive pressure to a patient's limb. These types of devices are used to assist mainly in the prevention of deep vein thrombosis (DVT), vascular disorders and the reduction of oedema. Prior art devices are adapted for use in a hospital setting in which they are used predominantly for the prevention of DVT in patients with a high risk for developing the same. U.S. Pat. No. 5,117,812, U.S. Pat. No. 5,022,387 and U.S. Pat. No. 5,263,473 (The Kendall Company), U.S. Pat. No. 6,231,532 (Tyco International Inc), U.S. Pat. No. 6,440,093 (McEwen et al) and U.S. Pat. No. 6,463,934 (Aircast Inc) disclose such devices.

Compression therapy is used in the treatment of venous leg ulcers. The treatment relies on the compression achieving a reduction in oedema and improved return of blood via the venous system. This in turn reduces the residence time for blood supplied to the lower limb and the severity of ischaemic episodes within the limb that can result in tissue breakdown.

Compression of the limb can be achieved by a pneumatic compression device. The known devices apply pressure to the limb through a thick cuff or cuffs which affect patient mobility and are aesthetically unacceptable to many patients. The pump that produces the compression is large and heavy and can supply fluid to the cuffs through many pipes. These characteristics make the known devices unsuitable for domestic use. It is believed that immediate mobilisation under compression post-surgery is beneficial in prevention of DVT, and existing pneumatic compression devices are unsuitable because of their size and weight, restricting patients to their beds while the treatment is applied.

Pneumatic compression devices do however have advantages. They provide an effective treatment, while deflated, the inflatable cuff or cuffs are easy to apply to the patient's leg and the pressure is more readily controlled and monitored. Also they are not subject to the effect of radius where the level of compression depends on the circumference of the limb so that high pressure occurs at the ankle and shin bones, where the radius under the bandage is reduced and low pressure spots occur in depressions such as those around the ankle. The effect of radius is a fundamental limitation of elasticated bandages and stockings.

Pneumatic compression devices do suffer from the problem that the shape and configuration of the cuff can lead to variations in pressure when the cuff is inflated. This is undesirable as in order for treatment to be most effective the whole area in need of treatment should receive compression. Most desirably the pressure distribution should be as even as possible. U.S. Pat. No. 6,494,852 to Barak describes a device which is said to be portable and ambulant. This device however comprises an inflatable sleeve with a plurality of cells arranged longitudinally along the sleeve from its distal part to its proximal part. The cells are of a simple, bag like construction which when inflated take on a cylindrical cross-sectional shape. We have found that such a shape when inflated leads to pressure high points and low points on the limb.

There thus exists a need for a cuff which gives a uniform pressure profile in the area of treatment along the limb with minimal pockets of high and low pressure when inflated.

SUMMARY OF THE INVENTION

We have now invented a device for applying compressive pressures against a patient's limb which alleviates the above problem by providing a device which is simple to apply to the limb, is small and lightweight and provides an even pressure to the limb. A first aspect of the present invention provides a compression device for the limb comprising:

- a sleeve adapted to surround the limb, the sleeve comprising an inelastic layer; and
- a cell constructed from an inner part joined to an outer part by one or more side walls so that the cell has a box-like configuration, the inner wall being adapted to conform to the shape of the limb when the cell is inflated to provide an even pressure to the limb.

We have found that such a device brings the advantages of even pressure to the limb.

Preferably the device further comprises:

- a conduit attached to the sleeve for delivering fluid to the sleeve; and
- a controller attached to the conduit that generates and controls the flow of fluid in the device.

Preferably the controller comprises a microprocessor control system and a pump. More preferably the device comprises at least one pressure sensor in the conduit or positioned in the device, the sensors providing readings of the pressure experienced by the limb due to the inflation of the sleeve by the controller.

The sleeve preferably comprises one or more individually inflatable cuffs. The cuffs comprise one or more cells formed from an outer part and an inner part. Preferably the inner part is elastic and is joined to the outer part by walls or gussets. On inflation of the cells, the walls allow the inner part to space itself from the outer part to present a continuous or substantially continuous surface of contact to the limb. Where the cells are placed next to one another the walls may substantially abut so that minimal areas of low pressure are created. The cells thus have a substantially box-like configuration on inflation.

The cells can be constructed in a number of ways. The inner part is preferably a layer co-planar with the sleeve which can be fixed to the sleeve by the side walls to form a closed cell or cells. Where the inner part is a continuous layer the side walls can be used to divide the continuous layer into a number of neighbouring closed cells. Alternatively the inner part and side walls can be vacuum formed from a single sheet which is then fixed to the sleeve.

Alternatively the cells can be constructed from an inner part joined to an outer part by side walls, the outer part then being joined to the sleeve. In such a construction the outer part and inner part can be made from layers of the same material which are joined together by side walls. A three layer assembly of this type has advantages over the two layer assembly described above in that the inner part and outer part of the cell can be the same material making the cell more likely to be airtight and the seal reliable. As the sleeve is not the outer part of the cell, the sleeve need not be made from an airtight material and can for instance be made of fabric. The three layer assembly also means that the welds used to join the cell parts together are not visible on the outer surface of the sleeve and the cells need not be attached to the sleeve over the whole of their surface. This means that it is possible to shape the sleeve to adapt more fully to the shape of the limb.

Preferably the sleeve is low profile and discrete. This allows the patient to use the device wearing ordinary clothes and shoes. The inelastic sleeve directs inflation of the cells towards the patients leg. The inelastic sleeve directs inflation of the elastic inner part towards the limb and allows the cell, when inflated, to conform to the profile of the limb. Preferably the cells are adapted to exert the required pressure on the limb while being partially physically inflated. This allows the elastic inner part of the cell to conform closely to the limb.

Preferably the sleeve comprises a leg cuff and a foot cuff both of which are low profile and discrete. More preferably the leg and foot cuffs are anatomically shaped to provide compression on those parts of the leg or foot which have the greatest effect on blood flow. This gives the advantage of reducing the overall size of the device and thus the profile of the cuff. Depending on the shape of the cuffs it can also reduce discomfort from pressure on bony areas of the limb.

Preferably the sleeve comprises two cuffs each of which preferably comprises at least one cell. The inelastic sleeve is preferably formed from a bonded laminate of two or more materials or from two or more separate materials securely attached together. For example the sleeve can be made from a polyurethane backed nylon. By inelastic in the context of the present invention is meant that the sleeve does not deform in use at normal operating pressure. For example the sleeve preferably has a Young's Modulus of between 150 and 300 MPa, more preferably 200 to 250 MPa. The comformable part of the cell is relatively thin, flexible and preferably has elastic properties to allow close conformity to the contours of the limb. By conformable in the context of the present invention is meant that the inner part of the cell is able to adopt the profile of the limb. It can be formed from a single layer or a laminate of two or more materials suitable for bonding or welding to form an air tight structure. Preferably the cell material is polyurethane or pvc. Preferably the cell material has a Young's Modulus of from 15 to 35 MPa, more preferably 20 to 30 MPa. In a specific embodiment of the device, each cell wraps around the lower limb but is contained within the leg cuff.

BRIEF DESCRIPTION OF THE DRAWINGS

Preferred embodiments of the invention will now be described with reference to the accompanying drawings in which.

DETAILED DESCRIPTION OF THE PREFERRED EMBODIMENTS

Figure 1:
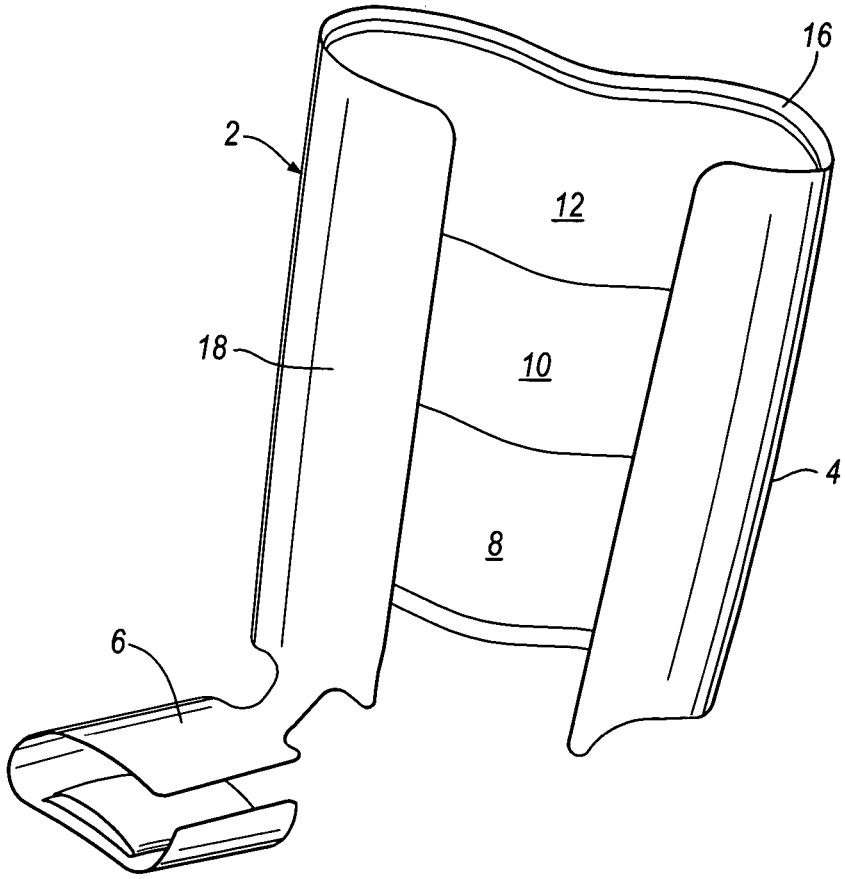
FIG. 1 is a perspective view of the sleeve of the device on the limb.

In FIG. 1 the compression device of the invention is shown. The device comprises a sleeve (2) having a leg cuff (4) connected to a foot cuff (6). The sleeve (2) may be connected to a controller by a conduit (not shown). The device may be used with a padded underlayer for instance a sock worn between the patient's leg and the sleeve (2). The sock when present absorbs any moisture from the patient's leg but does not apply significant compression. The sleeve (2) is formed from an inelastic material having an inner surface (16) and an outer surface (18). The leg cuff is divided into three cells (8), (10), (12) formed by adhesion of the inner part of the cell to the sleeve (2). In an alternative embodiment the cells comprise an inner part joined to an outer part, the outer part of the cell being joined to the sleeve.

As can be seen from FIG. 1, the patient puts the sleeve on by wrapping the leg cuff (4) and the foot cuff (6) around the leg or foot and securing them. The leg cuff (4) and foot cuff (6) are then inflated to apply pressure to the limb.

Figure 2:
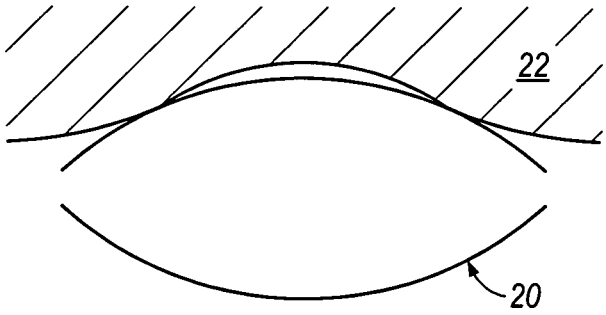
Fig.2 Prior Art
FIG. 2 is a cross-sectional view of a prior art sleeve secured on the limb with the sleeve in an inflated state.
Figure 4:
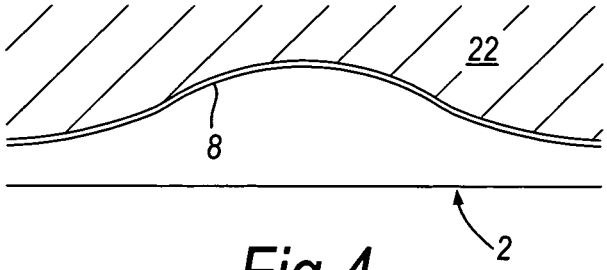
FIG. 4 is a cross-sectional view of the device of the invention secured on the limb showing the device in an inflated state.

FIG. 2 shows a cross-sectional view of a prior art sleeve (20) secured on a limb (22) with the sleeve (20) in an inflated state. The sleeve (20) is of a simple bag-like construction which on inflation adopts a cylindrical cross-section. As can be seen in FIG. 2 the sleeve does not conform to the contour of the limb on inflation. FIG. 4 shows a cross-sectional view of the sleeve (2) of the invention. As can be seen in FIG. 4 the conformable inner part of the cell (8) conforms to the contour of the limb (22) on inflation.

Figure 3:
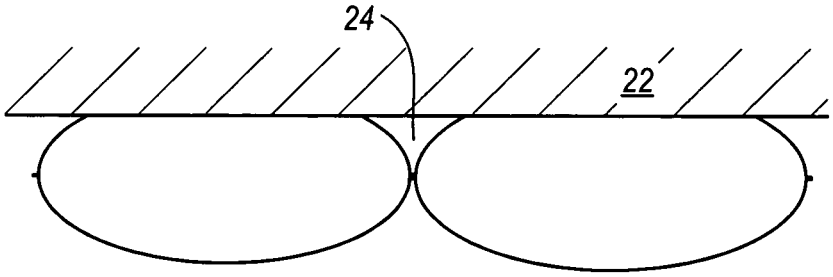
Fig.3 Prior Art
FIG. 3 is a cross-sectional view of a prior art sleeve showing gaps created between adjacent cells on inflation.
Figure 5:
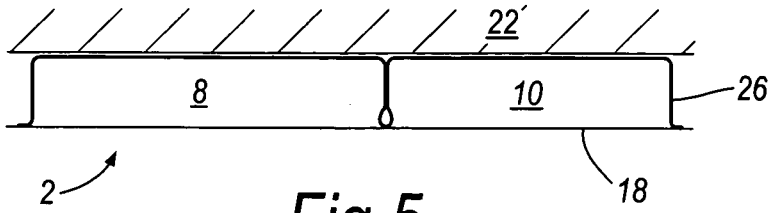
FIG. 5 is a cross-sectional view where the cells have a walled or gusseted configuration.

FIG. 3 shows a cross-sectional view of a prior art sleeve with simple bag-like cells and the gaps (24) created between such cells when they are inflated. FIG. 5 shows a cross-sectional view of the sleeve (2) comprising cells (8, 10) where the cells have side walls (26) which on inflation take on a box-like configuration. Such a configuration means that the walls of the cells may abut on inflation closing the gaps seen in FIG. 3.

Figure 6:
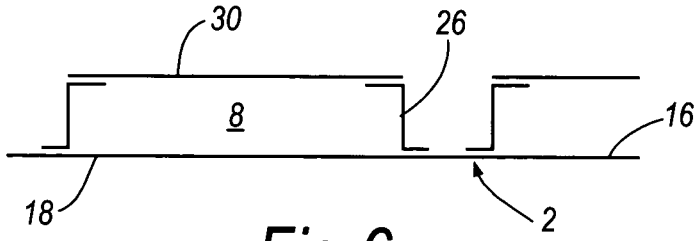
FIGS. 6 to 9 are cross-sectional views of alternative embodiments of cell construction.

FIG. 6 shows a cross sectional view of a cell (8) of the invention where the inner part (30) of cell (8) is joined to sleeve wall (16) by separate sections of side wall (26) which are welded to both the inner part and sleeve to make a box-like structure.

Figure 7:
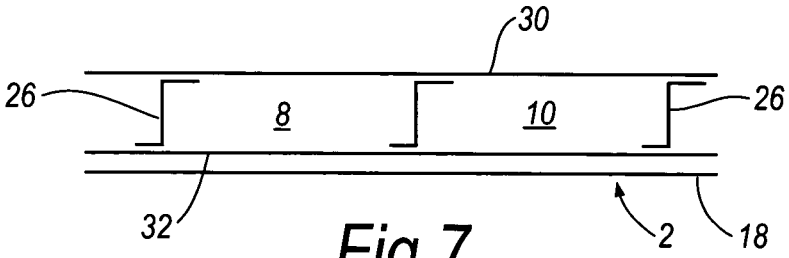

FIG. 7 shows an alternative embodiment of the cell structure of the sleeve where the inner parts (30) of the cells are joined to the inner wall of the sleeve (16) by separate walls (26) but the inner part (30) is a continuous sheet. The outer part (32) of the cells (8,10) is joined to the sleeve inner surface at the cell edges (not shown).

Figure 8:
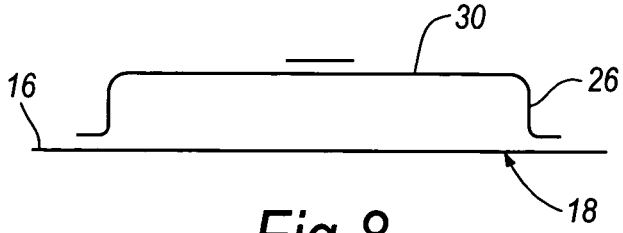

FIG. 8 shows an alternative embodiment of the cell structure of the sleeve where the inner part (30) and side walls (26) are pre-formed in an open box configuration by vacuum forming a single flat sheet of material which is then bonded or welded to the outer wall (16).

Figure 9:
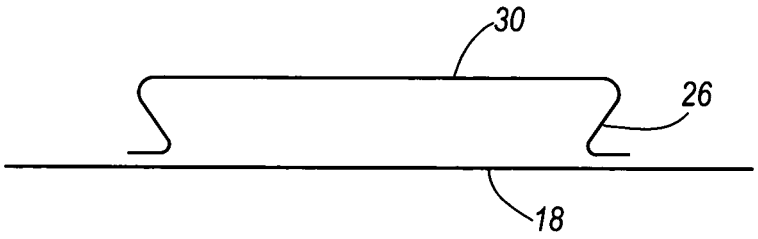

FIG. 9 shows an alternative embodiment of the cell structure of the sleeve where the inner part (30) and side walls (26) are pre-formed in an open box configuration by vacuum forming a single sheet but cut to allow excess material adjacent to the welds to make a baggy configuration. The pre-formed open box is then welded or bonded to the outer wall (18).

Figure 10:
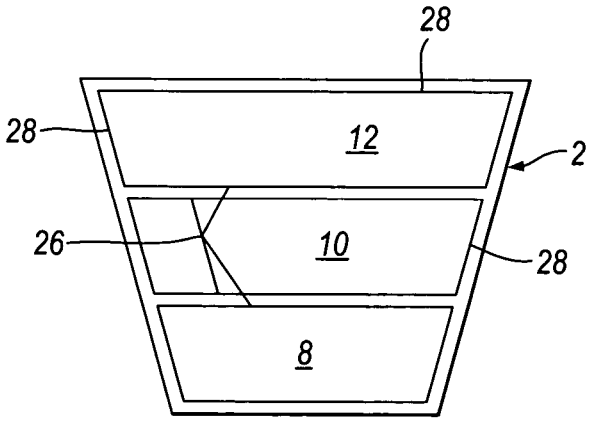
FIG. 10 is a plan view of the sleeve showing the inner part and arrangement of cells.

FIG. 10 shows an alternative embodiment of the sleeve of the invention where the sleeve (2) comprises three adjacent cells (8,10,12). The external edges (28) of the cells are not provided with side walls but the internal edges of the cells are provided with side walls (26).

The invention will now be illustrated by the following non-limiting examples.

Example 1

Figure 11:
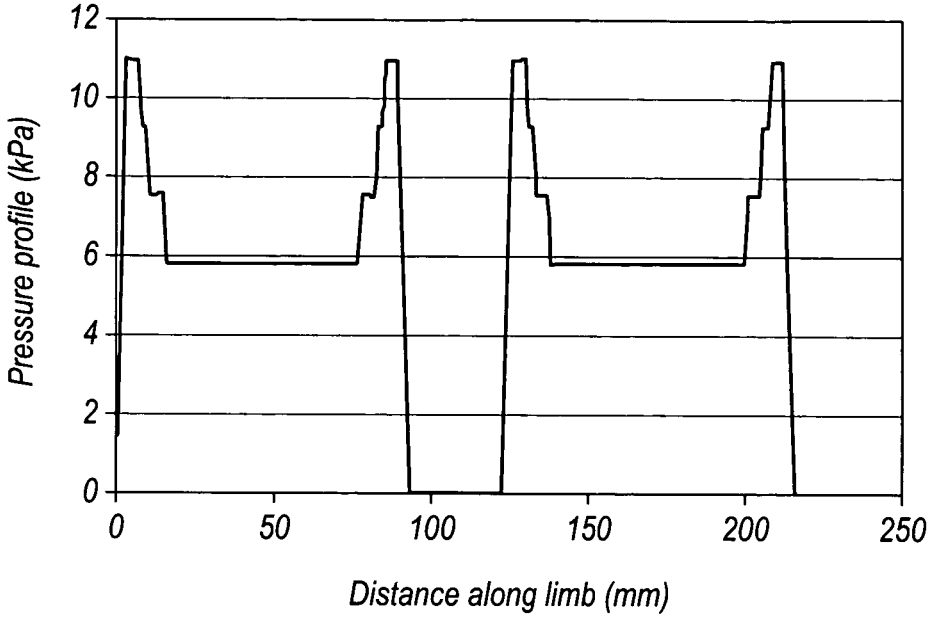
FIG. 11 is a graph showing the pressure profile along the limb for the device of FIG. 3.
Figure 12:
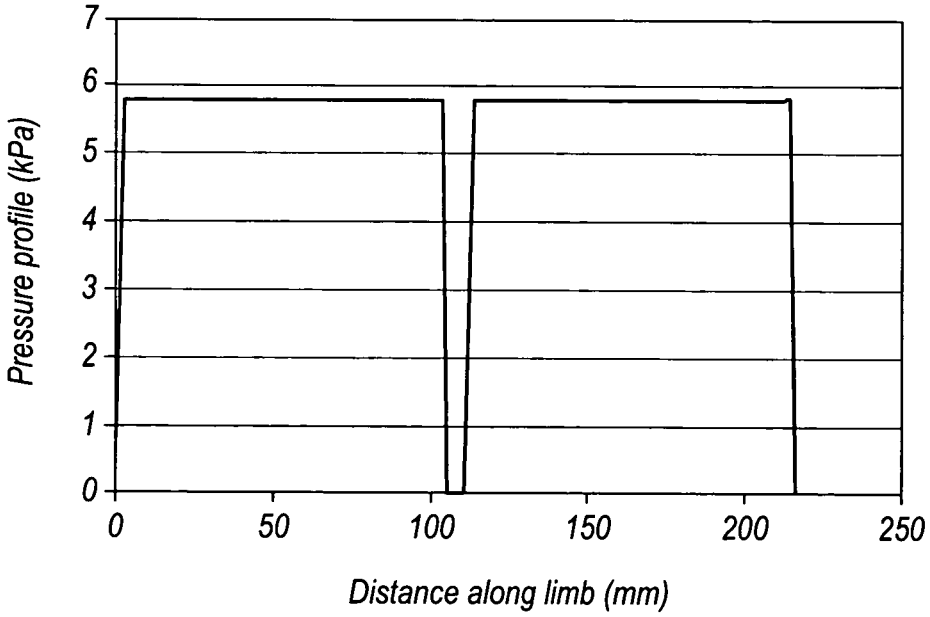
FIG. 12 is a graph showing the pressure profile along the limb for the device of FIG. 7.

Two adjacent cells of a device similar to that shown in FIG. 1 were the subject of a finite element analysis to simulate the pressure profile experienced by the limb when such a device is used. The analysis was conducted assuming a cell construction such as that used in FIG. 3 and compared to a cell construction such as that used in FIG. 7 where the cells have side walls. The analysis was conducted using Abacus UK Ltd software version 6.41. FIG. 11 shows the profile generated for the device of FIG. 3 where the cells are of a simple bag-like construction. The pressure distribution is uneven showing peaks at the edge of each cell which fall rapidly to a large area of zero pressure between the cells. The pressure is also depressed at the centre of each cell. By contrast the pressure distribution shown in FIG. 12 for the device of FIG. 7 is much more even with an even pressure across the cell width and only a small area of zero pressure between the cells. These figures show the advantages of the invention where the inflatable sleeve comprises an inelastic outer wall and a conformable inner wall divided into cuffs which when inflated conform to the shape of the limb to provide an even pressure to the limb.

The invention claimed is:

1. A compression device for a limb comprising:

a sleeve adapted to surround the limb, the sleeve comprising an inelastic layer; and at least two adjacent cells constructed from an inner part comprising a continuous surface joined to an outer part by one or more side walls so that at least one of the cells has a configuration which allows the inner part of the at least two adjacent cells to present a continuous surface of contact to the limb when the cell is inflated to provide an even pressure to the limb, and further wherein each of the at least two adjacent cells forms a portion of an external edge along a perimeter of the at least two adjacent cells and forms at least one internal edge between two adjacent cells, wherein the inner part and the outer part of each of the at least two adjacent cells is elastic and able to adopt the profile of the limb on inflation, wherein the sleeve, the inner part of the cell, and the outer part are co-planar layers, and further wherein at least a portion of the external edge of the at least two adjacent cells is fixed to the sleeve and the perimeter of the at least two adjacent cells lacks side walls, and wherein the at least one internal edge is provided with a side wall of the one or more side walls joining the inner part and the outer part.

2. The compression device for a limb as claimed in claim 1, wherein the sleeve is divided into two or more cuffs, each cuff comprising at least one cell.

3. The compression device for a limb as claimed in claim 2, wherein each cuff comprises more than one cell and the side walls of adjacent cells abut on inflation of the device.

4. The compression device for a limb as claimed in claim 1, wherein the device further comprises:

a conduit attached to the sleeve for delivering fluid to the sleeve; and a controller attached to the conduit that generates and controls the flow of fluid in the device.

5. The compression device for a limb as claimed in claim 1, wherein the inelastic sleeve does not deform in use.

6. The compression device for a limb as claimed in claim 1, wherein the outer part of each of the at least two adjacent cells is fixed to the sleeve.

7. A method for the treatment or prevention of venous leg ulcers, wherein the method comprises applying the compression device of claim 1 to a limb.

* * * * *

UNITED STATES PATENT AND TRADEMARK OFFICE

CERTIFICATE OF CORRECTION

PATENT NO. : 8,636,679 B2
APPLICATION NO. : 11/255051
DATED : January 28, 2014
INVENTOR(S) : Linnane et al.

It is certified that error appears in the above-identified patent and that said Letters Patent is hereby corrected as shown below:

On the title page, item (75) Inventors:

Delete "Fernadez", insert --Fernandez--;

Delete "Muhammed", insert --Muhammad--;

Delete "Sailm", insert --Salim--.

Signed and Sealed this
Twenty-second Day of April, 2014

Michelle K. Lee

Michelle K. Lee
*Deputy Director of the United States Patent and Trademark Office*